United States Patent [19]

Yaeger

[11] Patent Number: 4,901,969

[45] Date of Patent: Feb. 20, 1990

[54] BOOK SUPPORT WITH MEANS OF TEMPORARY ATTACHMENT ONTO A DESK

[76] Inventor: Ivan Yaeger, 1277 NW. 88th St., Miami, Fla. 33147

[21] Appl. No.: 241,048

[22] Filed: Sep. 6, 1988

[51] Int. Cl.[4] ..... A47G 1/24

[52] U.S. Cl. ..... 248/455; 248/231.8; 248/447.2

[58] Field of Search ..... 248/455, 454, 453, 463, 248/447.2, 231.8; 281/45, 15 B

[56] References Cited

U.S. PATENT DOCUMENTS

| | | | |
|---|---|---|---|
| 1,457,458 | 6/1923 | Plamondon | 248/455 |
| 2,183,810 | 12/1939 | Haveles | 281/15 B |
| 2,550,279 | 4/1951 | Mamer | 248/453 |
| 3,021,637 | 2/1962 | Huffman | 248/447.2 |
| 3,081,739 | 3/1963 | Mendels | 120/33 |
| 3,099,101 | 7/1963 | Burris | 248/447.2 |
| 3,153,400 | 10/1964 | Mendels | 120/33 |
| 3,484,072 | 12/1969 | Wilkin | 248/452 |
| 3,746,295 | 7/1973 | Stepanek et al. | 248/226 |
| 4,015,813 | 4/1977 | Graham | 248/452 |
| 4,496,126 | 1/1985 | Melton et al. | 248/447.2 |
| 4,682,749 | 7/1987 | Sträter | 248/284 |

FOREIGN PATENT DOCUMENTS

| | | | |
|---|---|---|---|
| 50787 | 2/1890 | Fed. Rep. of Germany | 248/447.2 |

*Primary Examiner*—Ramon S. Britts
*Assistant Examiner*—Karen J. Chotkowski

[57] ABSTRACT

A device capable of being clamped onto a peripheral edge of a desk or table, that can support reading material in either a horizontal or elevated position for convenient viewing. Said device is composed of a backrest 10 with lower lip 12 that will hold reading material, and spring-loaded clamping mechanism 14, attached to said backrest 10 via hinged clamp lever 16, that allows backrest 10 to be rested flatly or elevated by propping in an upright position with support leg 20. This device can also be used on the top of a worksurface by using spring-loaded clamping mechanism 14 as a supportive base, or folded compactly for easy storage and carrying.

7 Claims, 3 Drawing Sheets

BOOK SUPPORT WITH MEANS OF TEMPORARY ATTACHMENT ONTO A DESK

BACKGROUND

1. Field of Invention

This invention relates to bookstands and bookrests for use in supporting reading material in an upright position while being placed on or attached to a table or desk.

2. Description of Prior Art

Bookstands and bookrests that have been offered to consumers rest on the worksurface of a table or desk. Such devices allow reading material to be supported in a position that provides convenient viewing of said material, thereby freeing the user's hands so that other tasks (such as writing and typing) can be performed. However, these bookstands are of limited usage on small worksurfaces such as schooldesks because the device itself occupies a substantial amount of the available workspace, which prevents full usage of the desk. Moreover, bookstands of this type cannot be secured to the worksurface, making it possible to tip the device and the reading material over.

Several recent devices, described in the art as copyholders, feature the capability of being clamped onto a table. Unfortunately, such devices aren't compact enough for use on small worksurfaces (e.g. schooldesks), are designed to hold light-weight reading material only, and generally feature a clamping mechanism that can mar the finish of a worksurface or become easily dislodged. Moreover, such devices cannot be folded compactly for easy carrying and are not designed for table-top usage.

3. Objects and Advantages

Accordingly I claim the following as my objects and advantages of my invention: to provide a support for reading material that can be quickly and securely attached onto a peripheral edge of a desk or table in order to conserve worksurface space for other uses, and to provide such a device that allows the reading material being supported to be easily positioned in either an upright or horizontal fashion. In addition I claim the following additional objects and advantages: to provide such a device that can be placed directly on top of a worksurface as an alternative to temporary attachment, and to provide such a device that can be folded flatly to allow easy transport and storage.

Readers will find further objects and advantages of this invention upon reviewing the following descriptions and drawings.

DRAWING FIGURES

FIG. 1 shows a side view of the device that is clamped onto the edge of a desk with backrest 10 in horizontal position.

FIG. 2, which depicts the preferred usage of the invention, shows a side view of such device that is clamped onto the edge of desk with backrest 10 in elevated position.

Drawing Reference Numerals

Figure 1:
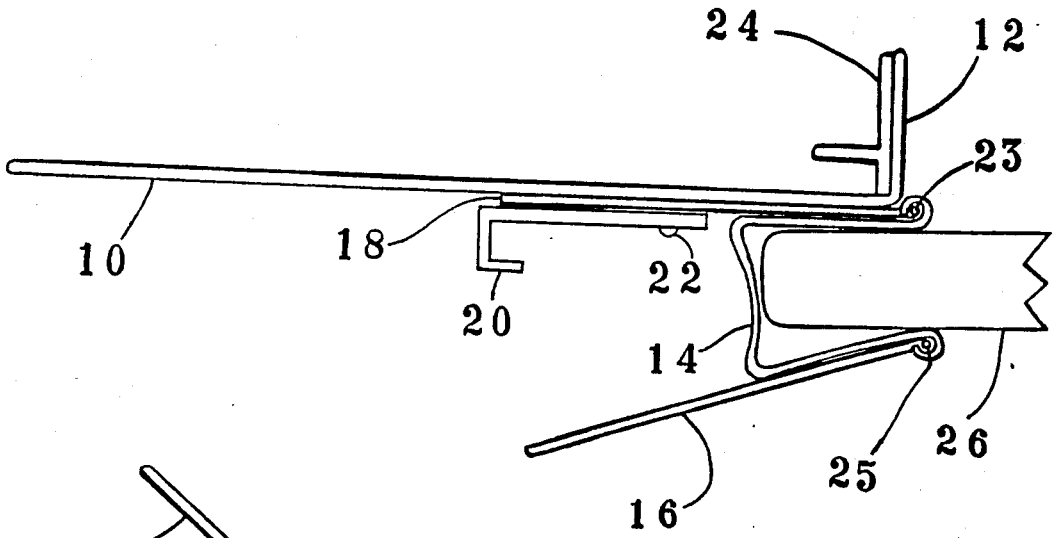

10 backrest
11 notch in 10
12 lower lip
13 notch in 12
14 spring-loaded clamping mechanism
16 hinged clamp lever
18 hinged mounting arm
20 support leg
22 rotating joint
24 side clip
26 desk edge
28 horizontal worksurface
30 reading material

DESCRIPTION

Figure 2:
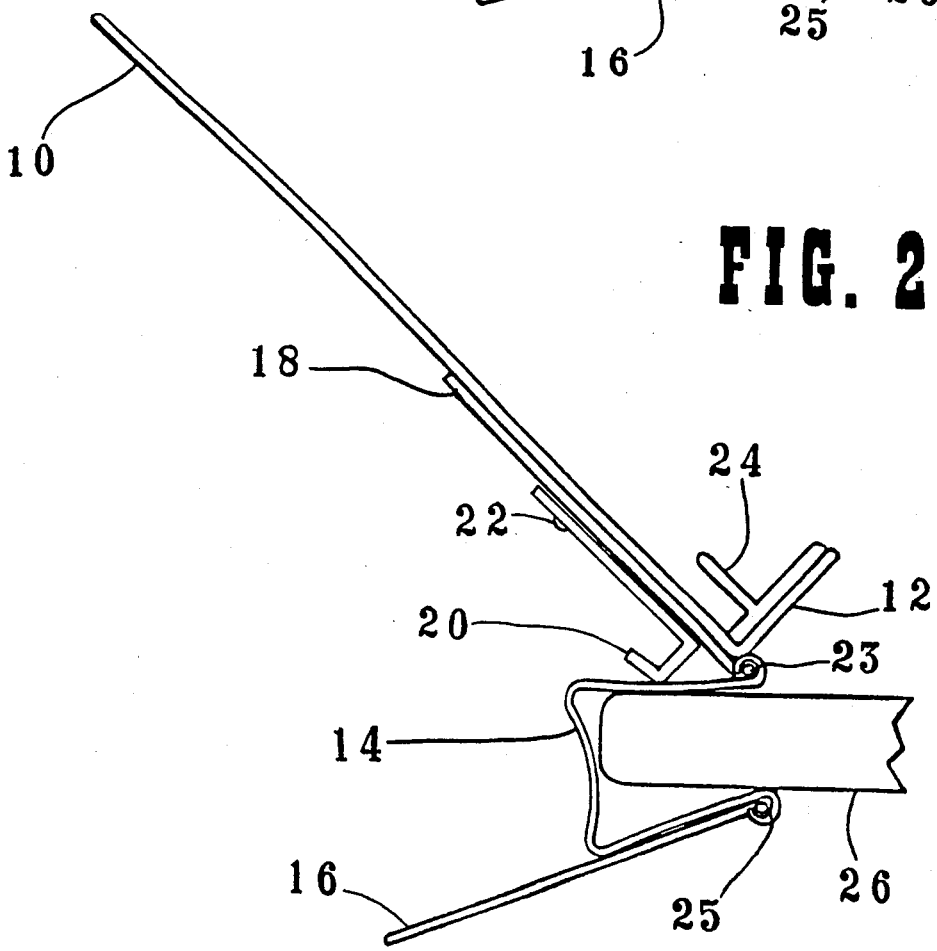
Figure 3:
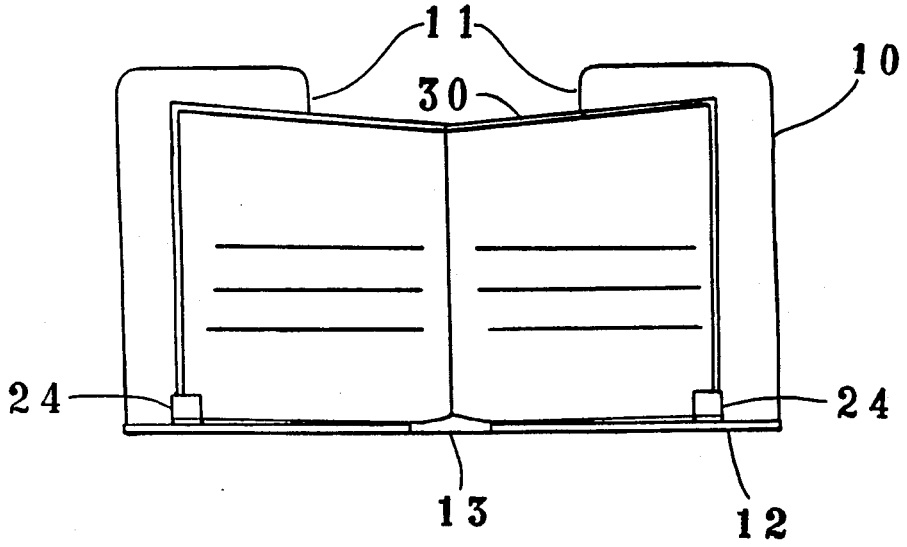
FIG. 3 is a front view of such device with reading material 30 being supported by the device.
Figure 4:
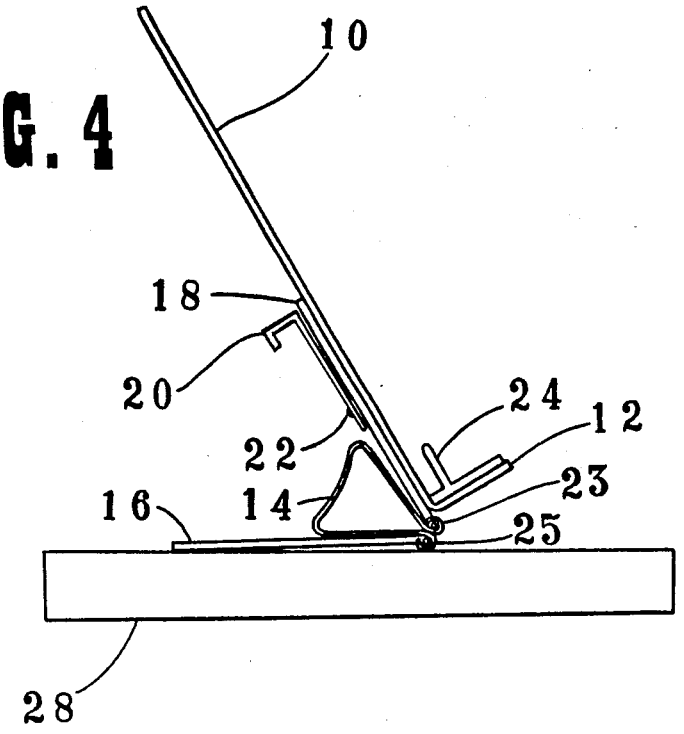
FIG. 4 shows a side view of such device being used as a desk-top bookstand.

FIG. 2 shows the device according to the preferred embodiment of the invention. The device comprises backrest 10 (preferrably made of metal, wood or plastic), with lower lip or projection 12 positioned in a 90-degree angle relative to backrest 10, and projecting one inch away from said backrest 10. Said lower lip 12 spans across the width of backrest 10, and has one or more side clips 24 defining gripping means for the reading material 30 attached onto the upper surface. Spring-loaded clamping mechanism 14 (Acco binder clip or similar), defining a clamp means as best seen in FIGS. 1, 2 and 3, is mounted permanently onto the reverse side of backrest 10 via hinged clamp arm or handle means 16. Support leg 20 is also mounted onto the reverse side of backrest 10 via rotating joint 22, which can be seen in FIGS. 1, 2 and 3. Backrest notch 11 and lower lip notch 13 are best seen in FIG. 4.

As clearly shown in FIGS. 1, 2, 3 and 5, the clamping mechanism 14 includes a first hinge assembly 23 serving to pivotally inter-connect the backrest to the clamping mechanism 14 and a second hinge assembly 25 serving to pivotally inter-connect the clamping mechanism 14 to the lever or handle means 16.

Operation

FIG. 1 illustrates usage of the device as a clamp-on bookstand. To attach this device temporarily onto a peripheral edge of a desk, the user rests the palm of the hand in notch 11, grasps backrest 10 and hinged clamp lever 16 between thumb and fingers and applies pressure. This procedure opens spring loaded clamping mechanism 14 and allows it to be placed onto a desk's edge. Upon release of backrest 10 and hinged clamp lever 16, spring loaded clamping mechanism 14 exerts sufficient clamping pressure to provide firm and stable support of the device and whatever reading material 30 is being used. The device can then be used with backrest 10 in a horizontal position as shown in FIG. 1, or in an upright position as shown in FIG. 2.

Upright position of backrest 10 is obtained by tilting backrest 10 upward via hinged clamp lever 16 and rotating support leg 20 (mounted to the reverse side of backrest 10 via rotating joint 22) downward until support leg 20 rests on the top face of spring-loaded clamping mechanism 14.

FIG. 3 illustrates that spring-loaded clamping mechanism 14 can be used as a supportive base for table top use. Hinged mounting arm 18 allows the top face of spring-loaded clamping mechanism 14 to be folded flatly against the reverse side of backrest 10 (when support leg 20 is not in use), allowing the bottom face of spring-loaded clamping mechanism 14 and hinged clamp lever 16 to rest on a desktop or tabletop. This provision also allows upright usage of backrest 10 without using support leg 20.

FIG. 4 shows that reading material 30 is supported (regardless of backrest 10 position) by resting reading material 30 on lower lip 12 and against backrest 10. Side clips 24 allow the reading material 30 to be secured against backrest 10.

Figure 5:
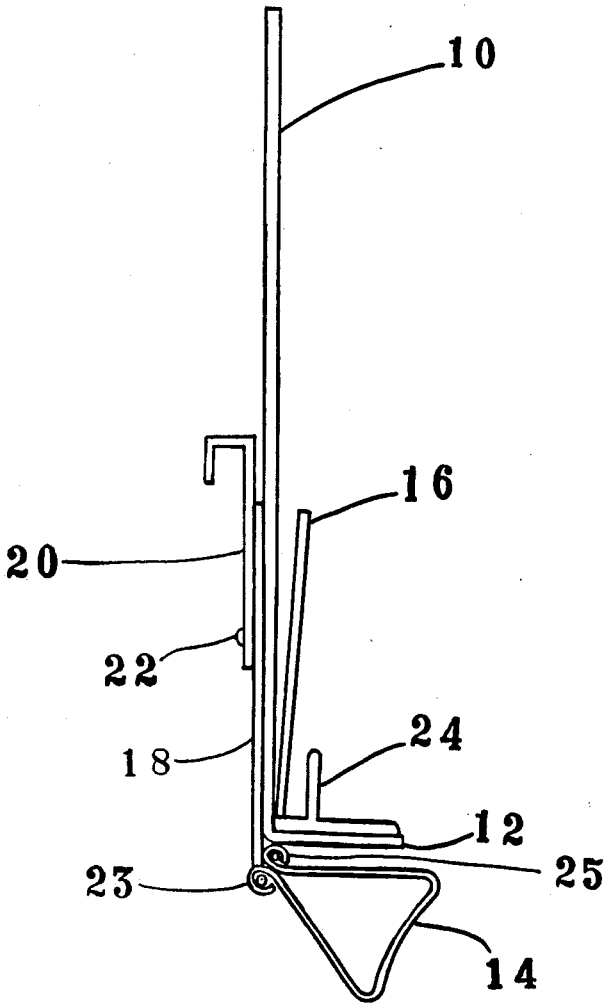
FIG. 5 shows a side view of such device that has been folded for easy storage and transport.

FIG. 5 illustrates that this device can be folded flatly by adjusting spring-loaded clamping mechanism 14 so that its bottom face rests against the bottom surface of lower lip 12. Hinged clamp lever 16 can then be folded flatly against the obverse face of backrest 10 by allowing it to rest in lower lip notch 13.

While the previous descriptions may present several specificities, these should not be construed by the reader as limitations of the invention's scope but as illustrations of the preferred embodiment thereof. Those skilled in the art may envision several other variations within this scope. For example, it is possible to use materials such as molded plastic, particle board or fiberglass instead of metal for constructing the backplate. It is also possible to mold the bottom edge of the backrest into a lower lip, or attach a separate length of material to said backrest to form such a lower lip. Side clips can assume several types of embodiment, from fixed to adjustable to various specialized shapes, sizes and materials. Additionally, the backrest support leg can be made to allow a wide range of backrest elevation angles. The backrest and spring-loaded clamping mechanism can also assume a wide range of physical dimensions, depending on the nature of the worksurface and the reading material being used. Accordingly, the reader is requested to ascertain the scope of this invention according to the appended claims and their legal equivalents, and not by the examples which have been given.

I claim:

1. A support device designed to support reading material in a viewable position, said support device comprising:

(a) a backrest configured to receive and support reading material of various sizes thereon, (b) a projection secured to a lower portion of said backrest and extending outwardly from an exposed supporting surface thereof, said backrest disposed to supportingly engage a lower end of the reading material, (c) a spring loaded clamping means movingly attached to said backrest and structured for clamping said backrest to an edge of a work surface, (d) a handle means movably connected to said clamping means and disposed and structured for opening said clamping means for clamping attachment to the edge of the work surface, (e) a first hinge assembly and a second hinge assembly, both secured to said clamping means, said first hinge assembly pivotally inter-connecting said clamping means to said backrest and said second hinge assembly pivotally inter-connecting said handle means to said clamping means, (f) said backrest disposable in at least one operative position and a closed position, said one operative position defined by said clamping means clamped on the edge of the work surface and said backrest extending outwardly from said work surface, and (g) said closed position defined by said clamping means pivoted into a folded orientation substantially adjacent and under surface of said backrest and said handle means pivoted into a folded orientation adjacent said supporting surface of said backrest.

2. A device as in claim 1 further comprising a support structure movably mounted on said backrest adjacent said clamping means and positionable into supporting engagement between one surface of said clamping means and said backrest; said backrest disposed into an angularly inclined orientation relative to the work surface to define a second operative position.

3. A device as in claim 2, wherein said backrest is disposed in substantially parallel relation to the work surface to further define said first operative position, when said support structure is disposed in a non-supporting position relative to the backrest.

4. A device as in claim 1, wherein a third operative position is defined by one exposed outer surface of said clamping means and said handle means positioned in supporting engagement on said work surface and another, outer exposed surface of said clamping means disposed in supporting, confronting relation to said backrest.

5. A device as in claim 4, wherein said backrest is angularly oriented to the work surface when in said third operative position.

6. A device as in claim 1 further comprising a gripping means mounted on said backrest and structured for retaining engagement with the reading material when supported on said backrest.

7. A device as in claim 6, wherein said gripping means comprises a plurality of clips mounted in spaced apart relation on said backrest and disposed to engage and retain a periphery of the reading material supported on said backrest.

* * * * *